US005695393A

United States Patent [19]

Granziera

[11] Patent Number: 5,695,393

[45] Date of Patent: Dec. 9, 1997

[54] TOOL FOR THE PRECISION PROCESSING OF OPTICAL SURFACES

[75] Inventor: Gilles Granziera, Pontarme, France

[73] Assignee: Loh Optikmaschinen AG, Germany

[21] Appl. No.: 562,289

[22] Filed: Nov. 22, 1995

[30] Foreign Application Priority Data

Nov. 26, 1994 [DE] Germany ..... 44 42 181.8

[51] Int. Cl.[6] ..... B24B 41/06; B24B 13/005

[52] U.S. Cl. ..... 451/390; 451/384; 269/22; 359/819

[58] Field of Search ..... 269/22, 266, 310; 451/42, 43, 53, 240, 255, 256, 277, 290, 323, 384, 390, 494, 495, 504, 514, 526; 359/819

[56] References Cited

U.S. PATENT DOCUMENTS

| | | | |
|---|---|---|---|
| 3,996,701 | 12/1976 | Ramirez et al. | 451/390 |
| 4,669,226 | 6/1987 | Mandler | 451/384 |
| 4,831,789 | 5/1989 | Herbin et al. | 451/495 |
| 4,852,631 | 8/1989 | Herbin et al. . | |
| 5,345,725 | 9/1994 | Anthony | 451/384 X |
| 5,357,716 | 10/1994 | Kishida et al. | 451/390 |
| 5,421,770 | 6/1995 | Bobst | 451/390 |
| 5,421,771 | 6/1995 | Wardle | 451/384 X |

FOREIGN PATENT DOCUMENTS

| | | | |
|---|---|---|---|
| 169931 | 2/1986 | European Pat. Off. | 451/390 |
| 0 286 481 A1 | 10/1988 | European Pat. Off. . | |
| 0 613 756 A1 | 9/1994 | European Pat. Off. . | |
| 2 612 823 A1 | 3/1987 | France . | |
| 2 654 027 A1 | 11/1989 | France . | |
| 42 14 266 A1 | 11/1993 | Germany . | |
| 54-121491 | 9/1979 | Japan | 451/495 |

*Primary Examiner*—Timothy V. Eley

*Attorney, Agent, or Firm*—McAndrews, Held & Malloy, Ltd.

[57] ABSTRACT

A tool for the precision processing of the optical surfaces of lenses has an elastic membrane (10), connected to a rigid holder (20), which incorporates a processing segment (11) and a bellows-type segment (12). Together, the membrane (10) and the holder (20) delimit a cavity (15), which is filled with a material (16) that becomes ductile under specific conditions, and which can be induced, at will, to form a flexible or rigid supporting layer for the membrane (10). When the material (16) is in its ductile state and the processing segment (11) contacts the optical surface, the bellows-type segment (12) exerts forces on the ductile material (16) which cause it to press the processing segment (11) against the optical surface, so that the tool retains its shape after the ductile material (16) has become rigid. As this tool can be used to shape any type of optical surface, it is particularly well-suited for the processing of prescription lens eyewear.

17 Claims, 5 Drawing Sheets

TOOL FOR THE PRECISION PROCESSING OF OPTICAL SURFACES

FIELD OF THE INVENTION

The invention consists of a tool for the precision processing of the optical surfaces of lenses. More specifically, the invention consists of a temporarily ductile tool for grinding or polishing optical surfaces, such as spherical, toric or aspherical surfaces of optical lenses, whose curvatures or radiuses of curvature are generally fixed following initial processing and which are used in shaping the curvatures of tools.

BACKGROUND OF THE INVENTION

Traditionally, form tools have been used for the precision processing (e.g., the processing steps which follow pre-grinding and consist of polishing, lapping or fine-grinding) of the optical surfaces of such items as lenses or eyeglass lenses. The grinding sheets or polishing compounds are placed on these tools. The working surfaces of these form tools are larger than the lens surfaces being processed. In addition, their radiuses of curvature correspond to the radiuses of curvature of the lens surfaces being processed in such a way that, for example, the concave curve of a lens can fit closely against the corresponding convex working surface of the tool.

Large numbers of these types of tools are needed in the prescription processing of eyeglass lenses. In order to ensure precessing of various eyeglass lenses, each of which has a different surface curvature according to its prescription. This means that one form tool is needed for each specific combination of eyeglass lens curvatures; in fact, in order to meet the demands of daily production, duplicate or even triplicate tools are needed for the more common prescriptions.

If we assume, for example, that the precision processing of eyeglass lenses requires coverage of lens curvatures ranging from a plane face to 10 diopters, at ⅛-diopter intervals, then 81 form tools are needed. An additional 2492 form tools are required when eyeglass lenses are made with up to 4 diopters of cylinder effect (also at ⅛-diopter intervals), which brings the total number of form tools needed to 2573.

In this context, one should also note that an optical laboratory should normally be equipped to produce eyeglasses with lens curvatures ranging from a plane face to 17 diopters, at ⅛-diopter intervals, and that these lenses may also require 0–6 diopters of cylinder effect, also at ⅛-diopter intervals, which only increases the number of form tools needed.

Finally, if a set of tools is arranged in ⅛-diopter intervals and is made in such a way that its curvatures correspond to a particular lens material with a predetermined refractive index, it may not be suitable for use with a different lens material that has a different refractive index. In such cases one must either resort to a set of tools arranged in finer gradations—at 1/16-diopter intervals, for example—or use a separate set of tools for each lens material that comes with its own specific refractive index.

The above argument clearly demonstrates that maintaining such a large inventory of tools not only involves a significant monetary investment, but also creates high costs in relation to storage, maintenance and labor.

The expense involved in manufacturing form tools presents yet another problem. These tools are generally made of a solid material, such as gray cast iron, steel, aluminum or plastic, and are metal-cut with toolmaking machines whose controls are capable of producing complex curvatures, so that form tools can be made with a wide variety of radiuses of curvature. The metal-cutting production of form tools designed for use with non-spherical surfaces can be particularly time-consuming and costly, as the precisely defined curvature of the edges of such form tools may differ substantially from that of the tool's primary surface.

In an attempt to resolve these issues, it has been suggested that the form tool be cast on the basis of the lens surface curvature established after pre-processing. Essentially, what this means is that the lens surface acts as part of the casting mold, or as the core. Even though this method reduces the cost of producing form tools, it does not alleviate the problems associated with storing the large numbers of tool curvatures described earlier.

In order to address this problem, the polishing tool described under FR 2 612 823 A1 has a rigid holder which contains a recess into which a temporarily ductile buffer can be inserted. This buffer has two elastically ductile membranes, whose outer rims are attached separately to the inner walls of the groove, so that the membranes run parallel to the axis of the holder. The outer membrane acts as the tool's processing surface, which is larger than the lens surface being processed, while the inner membrane divides the groove into two segments. The outer segment, located between the outer and inner membranes, is filled with an incompressible filling material, such as glass or metal granules, and can be connected to a vacuum, if desired. Conversely, pressurized air can be applied to the inner segment, which is located between an inner wall of the holder and the inner membrane, if desired.

The following example demonstrates how the tool described in FR2 612 283 A1 works in practice. Before a concave lens is processed, its surface curvature is shaped by first subjecting the tool's outer segment to ambient pressure to make it ductile, and then applying pressurized air to the inner segment so that the outer membrane (the processing surface) can be adapted to the curvature of the lens. The outer segment is then subjected to a vacuum. This causes it to become virtually rigid and causes the outer membrane to maintain the curvature of the lens (as negative pressure) until the lens has been processed, whereupon the outer segment is once again exposed to ambient pressure. The inner segment can continue to be subjected to pressurized air during processing, as this counteracts the force of the lens surface on the processing surface.

However, when lenses are processed in this manner, it has been shown that when the smaller lens surface is being shaped by the tool's larger processing surface, the latter assumes an unknown curvature that is not the same as that of the lens surface, particularly in the section of the processing surface opposite the edges of the lens surface. As a result, sections of the lens surface being processed may not be polished sufficiently and/or the curvature of the lens may change to conform to the curvature of the tool.

For the above reasons, the outer segment described earlier under FR 2 612 823 A1 was divided, under FR 2 654 027 A1, into four separate pie-wedge shaped segments, each of which is filled with the incompressible filling material and can be subjected to a vacuum. To shape the lense, the lense is placed eccentrically on the tool's processing surface, which now consists of four separate surfaces. Through the use of a complex transport mechanism, the lens is physically moved into four different precisely defined positions, so that each of the pie-shaped segments can be adapted to the curvature of the lens. Each individual adaptation or shaping procedure follows the steps described under FR 2 612 823 A1.

Because the smaller lens surface is used to shape the curvature of the tool's larger processing surface through appropriate positioning of the lens surface, the curvature of the processing surface will only match the curvature of the lens surface for spherical lenses whose radius of curvature remains constant across the entire lens surface, provided the lens surface was correctly positioned during the forming process. For all other types of lenses, e.g., those whose surfaces incorporate several different radiuses and/or whose edges form three-dimensional finite lines, and which represent approximately 80% of prescription eyeglasses, the tool described above can only provide an approximation of the desired outcome. As a result, such items as plano-cylindrical lenses and sphero-cylindrical lenses cannot be properly polished in isolated spots with this tool, and/or the tool's inherent curvature changes the curvature of these types of lenses.

Therefore, the primary task of this invention is to enhance the above-described state of the art in such a way, that the membrane can be more closely adapted to the lens being processed.

SUMMARY OF THE INVENTION

Therefore, according to invention, a bellows-type segment is inserted between the tool's elastic membrane's processing segment and the piece that connects the membrane to a rigid holder which, together with the membrane, delimits a cavity filled with a ductile material. When the processing segment comes into contact with the optical surface, the bellows-type segment exerts enough pressure on the ductile material to force it to press the membrane's processing segment onto the optical surface.

Any lens curvature can be shaped with the tool described in this invention. In contrast to the state of the art described under FR 2 654 027 A1, in which each of the four sectors of the tool described therein is shaped in sequence by shifting the lens into several eccentric positions, the tool described in this invention has the advantage that it is shaped centrally in a single procedure. However, in order to process non-spherical optical surfaces, the membrane's processing segment must be the same size as or smaller than the optical surface being shaped.

The design of the membrane described in this invention has the following effect: a groove in the membrane's processing segment, which was created by pressure applied to the membrane during shaping, changes the distribution of forces in the ductile material in such a way, that the sections of the processing segment that have not yet come into contact with the lens, especially the edge of the membrane, are essentially lifted in the direction of the lens. At the same time, the use of a bellows-type segment makes it possible to shape the membrane's processing segment. During the shaping of toric lenses, for example, two diametrically opposed edges of the membrane's processing segment may be indented. When this occurs, the special shape of the membrane (bellows-type segment) ensures that the membrane edges on the other coordinate are lifted toward the lens, which makes it easier to adapt to toric lens shapes.

The tool described in this invention can be used in lens processing procedures in which the tool guides the lens, as well as in processing procedures in which the lens guides the tool. The element shared by these two types of processing procedures is that a section, i.e., either the lens (and/or the workpiece holder holding the lens) or the tool itself, is connected to a device, such as a lens polishing machine, while the other part (tool or lens) is mounted, either through a ball-point surfacing pin/spherical cap or a membrane liner, on gimbals to a center sleeve or an axially displaceable spindle. This center sleeve presses the lens and the tool together, whereby the part that is mounted on gimbals (tool or lens) is oriented toward the part that is rigidly attached to the motorized spindle. In the processing procedure in which the tool guides the lens, once the lens has been shaped it is ground to either a round shape or to a shape that matches the shape of the frame (i.e., de-centered); in contrast, de-centering the lens prior to processing is not required in the processing procedure in which the lens guides the tool.

According to one embodiment, the bellows-type segment consists of two segments. A first segment lies adjacent to the edge of the processing segment and tapers, preferably in conical fashion, in the direction of the holder. A second segment lies adjacent to the first segment and widens, preferably in conical fashion, in the direction of the holder. This bellows-type segment is either directly or indirectly connected to the fastening segment, which ensures that the membrane's processing segment can be easily shaped. This design can be further improved if the second segment of the bellows-type segment is connected, through the third segment, which is preferably tapered in conical fashion in the direction of the holder, to the fastening segment.

The ductile material should, preferably, consist of a foamed material with memory capacity (memory effect), or an alloy with a low melting point (wood-metal), either of which can be easily transformed from a rigid to a soft state (or vice-versa) by subjecting it to different temperatures.

In processing procedures in which the lens guides the tool, it is preferable to use a lightweight tool so that amount of mass that has to be moved can be kept to a minimum. In order to accomplish this feature, embodiments are disclosed which reduce the size of the cavity, and hence the amount of ductile material required to fill the cavity. In addition to the advantage achieved by reducing the weight of the tool through the use of a smaller amount of ductile material, these embodiments provide the further advantage of reducing the amount of ductile material that has to be heated or cooled, thereby reducing the amount of energy needed to alter the state of the ductile material.

The device used to heat or cool the ductile material may be located inside the flange. This arrangement heightens the efficiency of the heating and cooling procedures.

Additionally, a sensor can be incorporated into the tool to monitor the condition of the ductile material. This helps in optimizing the tool's application. For example, use of this sensor ensures that the shaping procedure can begin as soon as the ductile material has reached a sufficient degree of softness; conversely, it ensures that processing of the optical surface can begin as soon as the ductile material has reached a sufficient degree of hardness.

Other objects and advantages of the invention will become apparent upon reading the following detailed description and appended claims and upon reference to the accompanying drawings.

BRIEF DESCRIPTION OF THE DRAWINGS

In the following, the invention is described in greater detail through the use of preferred embodiments which are explained through reference to the figures shown. The same reference marks are used to label identical or similar parts in all of the figures, which are as follows:

FIGS. 2D through 2F are sectional views of figures 2A through 2C along an A—A axis

DETAILED DESCRIPTION OF THE PREFERRED EMBODIMENT

Figure 1:
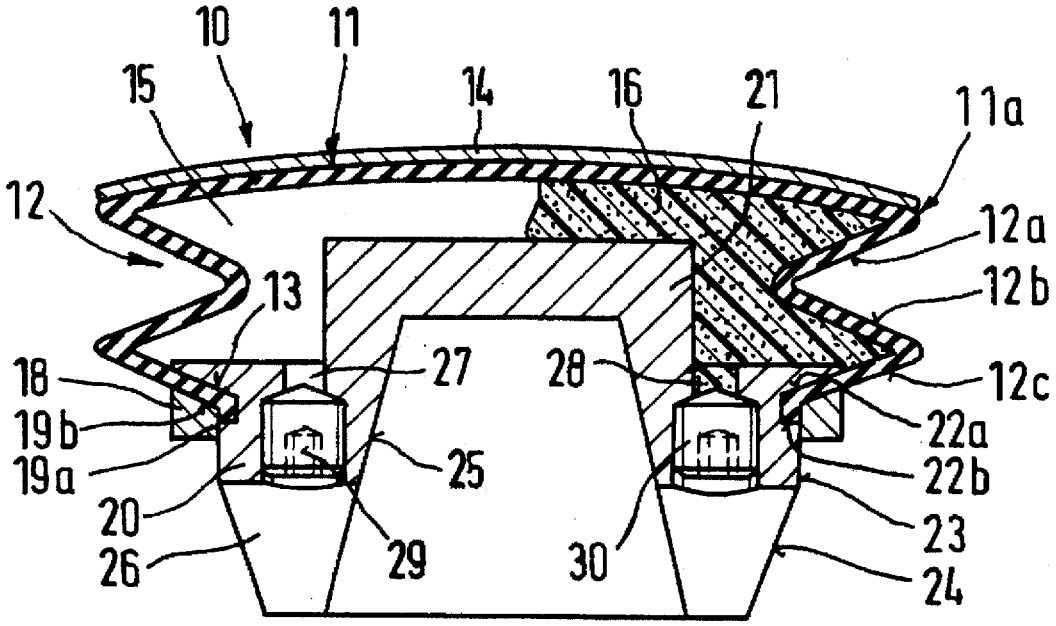
FIG. 1 is a sectional view of a first embodiment of the tool described in the invention.

As shown in FIG. 1, a tool for the precision processing of optical surfaces has an elastic membrane (10), which includes a processing segment (11) connected to a fastening segment (13) through a bellows-type segment (12). The fastening segment (13) is used to secure the elastic membrane (10) to a rigid holder (20). Together with the elastic membrane (10), the rigid holder (20) delimits a cavity (15) filled with a material (16) that becomes ductile when heated, so that the elastic membrane (10) can be fitted to the curvature of the optical surface to be processed when the ductile material (16) is in a heated state. When the processing segment (11) comes into contact with the optical surface being processed, the bellows-type segment (12) of the elastic membrane (10) impinges on the ductile material (16) with a force sufficient to cause the ductile material (16) to press the processing segment (11) against the optical surface being processed. At the same time, the bellows-type segment (12) allows for substantial deformation of the processing segment (11).

The bellows-type segment (12), which is part of the rotationally symmetrical elastic membrane 10 in the illustrated embodiment, attaches directly to the outer edge (11*a*) of the processing segment (11). This bellows-type segment (12), which runs from the outer edge (11*a*) of the processing segment (11) to the hollow cylindrical fastening segment (13), consists of the following sequence of parts, all of which are made of the same material: a first segment (12*a*), which tapers radially; a second segment (12*b*), which widens radially; and a third segment (12*c*), which also tapers radially and is connected to the fastening segment (13). This arrangement makes it possible to employ the entire surface of the processing segment (11), including its outer edge (11*a*), in processing the optical surface. In the illustrated embodiment, the radially tapering segments (12*a*, 12*c*) and the radially widening segment (12*b*) are conical; however, these components can also be spherical (mantle segment of an ellipsoid) or saddle-shaped (mantle segment of a single-layered hyperboloid).

As will be explained in greater detail below, the first segment (12*a*), which attaches to the outer edge (11*a*) of the processing segment (11), as well as the adjoining second segment (12*b*), are particularly critical to the tool's performance. In the illustrated embodiment, these two segments (12*a* and 12*b*) form an outer wall of the membrane (10), consisting of two opposing truncated cones (based on their smaller cross-sections). These two segments (12*a* and 12*b*) can be of different sizes, i.e., they may differ in diameter and/or depth, and must not necessarily be rotationally symmetrical. Depending on the curvature of the edge of the processing segment, they may also exhibit an elliptical or angular shape when viewed in cross-section.

The third, radially tapering, segment (12*c*) of the bellows-type segment (12), which adjoins the other two segments (12*a* and 12*b*), helps to improve the ability of the membrane's (10) processing segment (11) to conform to the shape of the optical surface being processed. This function will be explained will be explained in greater detail below. The membrane's (10) fastening segment (13) can also be directly connected to the bellows-type segment (12) radially widening segment (12*b*).

Although it is not apparent in FIG. 1, the thickness of the membrane (10) has been determined as follows: the sections of the membrane that will be subjected to pressure during processing or shaping are thicker than those that will be subjected to tension.

The membrane (10) is preferably made of a material that has sufficient elasticity and maintains its shape to an acceptable degree. A suitable material is rubber, which has all the desired properties, including tightness and elasticity (flexibility). The rubber membrane is designed to have a flexibility under a pressure less than would deform a relatively thin optical lense made of a plastic material. When the membrane is formed of rubber, a coating (14), as shown in FIG. 1, is applied to the membrane's (10) processing segment (11). A liquid or solid grinding or polishing agent can be applied to this coating when processing optical surfaces. The coating is a synthetic (plastic) material. Suitable materials include poylyurethane, polyurethane-elastomers (such as Desmopane or Desmoflex which are available from BAYER), or black policore-foil. Alternatively, the membrane (10) itself can also be made of a suitable plastic (such as those listed above), so that its processing segment (11) can act directly as a carrier for the polishing agent.

The membrane's (10) fastening segment (13) is attached to the holder (20) with a tension ring (18). The tension ring (18) has a tension segment (19) which, in turn, consists of a hollow cylindrical tension segment (19*a*) and a conical tension segment (19*b*). Accordingly, the membrane's (10) holder (20) has a tension segment with a conical tension segment (22*a*) and a groove (22*b*). When the membrane (10) is in its fully assembled state, the membrane's (10) fastening segment (13) is pressed through the tension ring's (18) hollow cylindrical tension segment (19*a*) and into the groove (22*b*) in the holder (20). At the same time, the conical tension segment (19*b*) of the tension ring (18) presses the third, radially tapering, segment (12*c*) of the membrane's (10) bellows-type segment (12) against the conical tension segment (22*a*) of the holder (20). This ensures that the cavity (15), which is filled with ductile material (16) and is primarily delimited by the membrane (10) and the holder (20), remains hermetically sealed to the outside.

Foamed material with memory capabilities, commonly known as (memory foam), is particularly suited for use as the ductile material (16). A product sold by Ranwal Ltd., Great Britain, under the commercial name of "Flegmat" is an example of this type of foamed material. This product has a congealing temperature of approximately 30° C.; it remains elastic but somewhat rigid when below its congealing temperature, while it becomes easily ductile at temperatures above 30° C. Because of these properties, the ductility level of the membrane's (10) processing segment (11) can be temporarily altered by changing the temperature of the ductile material (16).

An incompressible highly fluid alloy with a Bi component of 50% or more can also be used as a ductile material, as this type of alloy has a low melting point and experiences either very minor shrinkage or none at all when the molten material congeals. An example of such a material is a wood alloy (wood-metal) which has a melting point of approximately 70° C., and has the following chemical composition: 50% Bi, 25% Pb, 12.5% Sn and 12.5% Cd (eutectic). The use of a highly fluid alloy for the ductile mass (16) is particularly appropriate when it is desirable to have a tool that remains very stiff in its non-ductile state. These types of alloys generally have a high specific gravity, which can have a disadvantageous effect on the tool's overall weight, particularly for tools that are used in processing procedures in which the optical surface being processed guides the tool, and in which the tool should be as light as possible. Therefore, in order to reduce the amount of ductile material (16) needed to fill the cavity (15), granules or small balls made of a rigid material with a significantly lower specific gravity than that of the ductile material (16) can be added to the ductile material (16).

While the two materials mentioned in the examples above are both temporarily ductile in relation to temperature, one can also use materials whose ductility can be influenced through other means, such as chemical reactions. An example of such a material is one which can be easily transformed from a rigid state to a soft state, or vice-versa, through changes in temperatures and/or chemical reactions.

As shown in FIG. 1, the rigid holder (20) also has a cylindrical projection (21), which projects into the cavity (15), thus reducing the volume of the cavity (15). By reducing the volume of the cavity (15), this cylindrical projection (21) serves two purposes: first, it helps lower the weight of the tool when highly fluid alloys are used as ductile material (16); second, it reduces the amount of energy needed to alter the condition of the ductile material (16). Because the use of the cylindrical projection also minimizes the space delimited by the membrane (10) and the holder (20), the amount of time required for the shaping procedure (which will be described in greater detail below) can be reduced in an advantageous manner. Furthermore, depending on the tool's intended purpose, the size of the projection (21), which affects both the volume of the cavity (15) and the choice of materials for the ductile material (16), can be used to determine the elasticity of the tool in relation to the forces produced during the processing of optical surfaces; this also influences the maximum level of processing pressure to which the tool can be subjected. Finally, appropriate shaping of the projection (21) can ensure that a more-or-less constant average distance is maintained between the membrane's processing (11) and bellows-type (12) segments, on the one hand, and the holder (20), on the other. This helps to simplify the shaping procedure. The dimensions of the projection (21) also depend on the desired ductile behavior of the membrane (10), which should not collide with the projection (21) when its shape changes.

The rigid holder (20) also includes a cylindrical outer surface (23) which is partially covered by the tension ring (18) when the membrane (10) is in its fully assembled state. Another outer surface (24), which tapers conically away from the membrane (10), adjoins the cylindrical outer surface (23) of the holder (20). This outer surface (24) acts as a receptacle pin, which makes it possible to mount and position the tool on a processing machine. Particularly in processing procedures in which the optical surface being processed guides the tool, the outer surface (24) is sufficient as a mounting for the tool itself.

The side of the holder (20) that away from faces the membrane (10) contains a truncated groove whose walls form the holder's (20) energy transfer segment (25). Thermal energy generated by the external energy source of a transformer (not depicted) is conducted to the ductile material (16) through this energy transfer segment (25), thus heating the material (16) temporarily and making it ductile, so that the tool can be shaped to conform to the optical surface being processed. The pin-shaped design of the holder's (20) energy transfer segment (25) ensures that the tool can be easily connected to a conical socket in the transformer, whereby the interlocking connection between the transformer's conical socket and the holder's (20) energy transfer segment (25) enhances the efficiency of heat transfer to the ductile material (16). It is clear that the choice of the material used to make the holder (20) is heavily dependent on the consistency of the ductile material (16) and, consequently, the amount of energy needed to alter that consistency.

In the embodiment shown in FIG. 1, the energy needed to change the consistency of the ductile material (16) comes from an external source. As a result, because the tool itself does not have to incorporate any heating or cooling equipment, the embodiment depicted in the figure is relatively light and is, therefore, particularly well-suited for use in processing procedures in which the optical surface being processed guides the tool.

In cases in which the optical surface being processed is not rotationally symmetrical—for example, if it has a toric, progressive or atoric curvature—the optical surface being processed and the tool must be oriented toward one another in each rotated position, and must remain in those positions throughout processing. This can be achieved through the use of inter-locking components (grooves, braces, etc.). Accordingly, there is a v-shaped (when viewed in cross-section) groove (26) in the surface of the holder (20) facing away from the membrane (10), which is used to orient the tool in peripheral direction, while the tool holder's (20) cylindrical outer surface (23) is gripped with pliers. If the optical surface being processed is tilt-symmetrical, as in the case of a simple toroid, the groove (26) which runs in the radial direction of the holder (20) is sufficient to orient the tool toward the optical surface. In the case of progressive surfaces, which are not symmetrical, a distinction must be made in the eyeglass prescription between the left and the right lenses. In such cases, an additional interlocking notch is needed to orient the main axes, or the v-shaped groove can only be single-sided. The one-sided arrangement of the groove needed to complete the interlocking function is a simple way to prevent unwanted 180° rotations.

There is an inflow channel (27) and an outflow channel (28) in the floor of the holder's (20) v-shaped groove (26). These channels run more-or-less parallel to the holder's center axis, and stretch from the outside surface to the cavity (15), where they merge on the two sides of holder's (20) projection (21). These channels (27, 28) are used to fill the cavity (15) during tool assembly. The soft or fluid ductile material (16) is filled into the cavity (15) through the inflow channel (27), while air from the cavity (15) can escape through the outflow channel (28). The cavity (15) is completely full when the ductile material begins to emerge from both channels (27, 28); at this point, the channels (27, 28) can be sealed with threaded plugs (29, 30). The channels (27, 28) do not necessarily have to be located in the positions shown in the drawing. However, they should be positioned in a way that ensures optimal filling of the cavity (15), i.e., so that no air bubbles remain in the cavity (15) after the channels (27, 28) have been sealed off.

Another option is to seal the ductile material (16) into the cavity (15) during the manufacture of the membrane (10). A ductile material (16) consisting of a highly fluid alloy, for example, can be machined in its rigid state on a tooling machine, until it corresponds to a negative imprint of the interior shape of the membrane (10) being manufactured. In the next production step, the pre-shaped ductile material (16) and the holder (20) can act together as the inner component of a vulcanization mold used to make the membrane (10). Provided the material used is suited for such purposes, the membrane (10) can also be made by using a brush or spray gun to apply the membrane material onto the pre-shaped ductile material (16). The channels (27, 28) can be dispensed with in either of these instances.

Figures 2A, 2B, 2C, 2D, 2E, 2F:
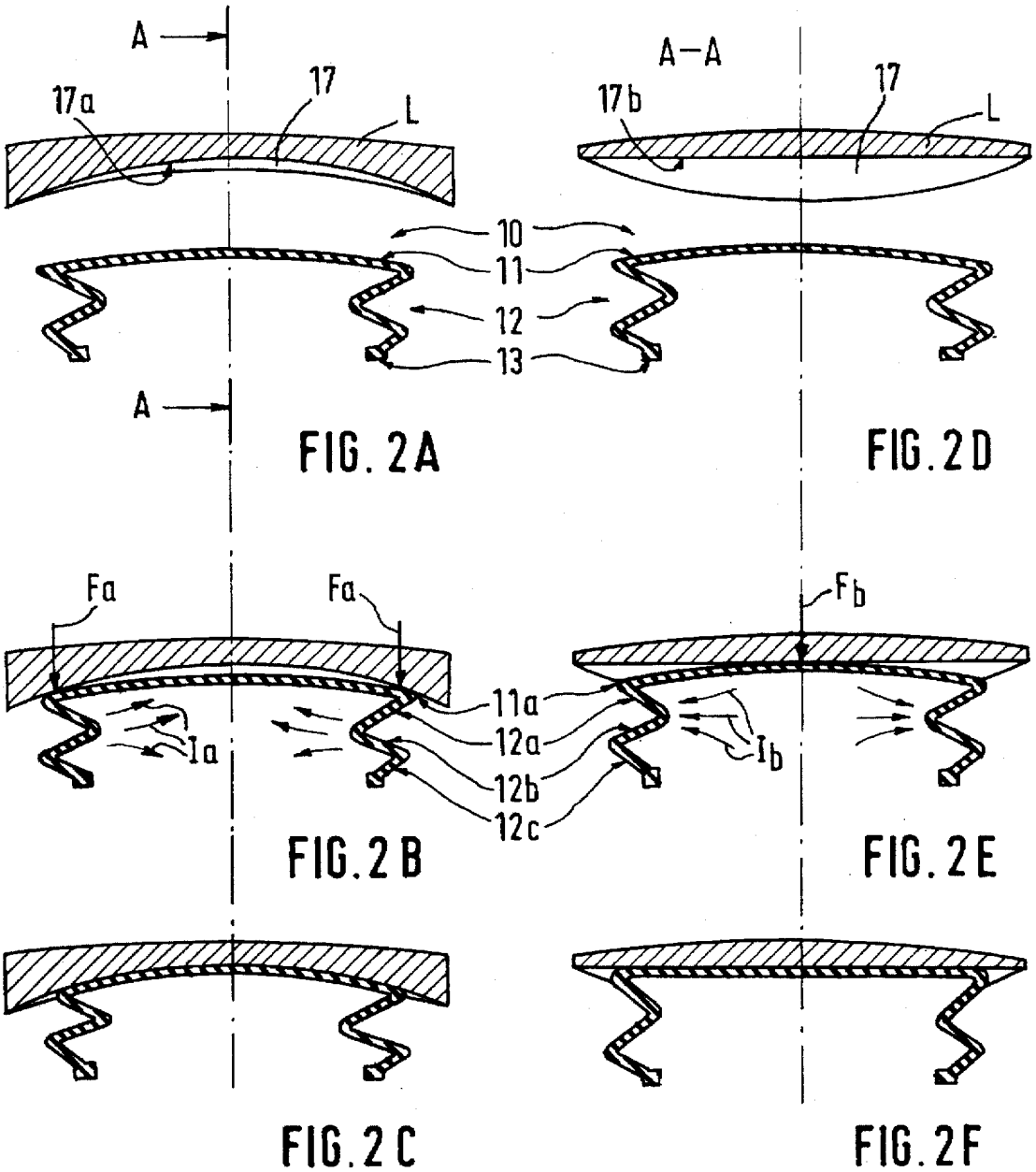
FIGS. 2A through 2F are schematic representations of various phases of the adjustment or shaping procedure for a tool based on the invention, whereby

The procedure by which the elastic membrane's (10) processing segment (11) is used to shape the curvature of an optical surface (17) is explained in the following text, using FIGS. 2A through 2F for reference purposes. FIGS. 2D through 2F are sectional views of FIGS. 2A through 2C, along the line A—A. Although the procedure is explained here on the basis of a toric surface, it could just as easily apply to a spherical or aspherical surface.

As is particularly evident in FIG. 2A and 2D, the lens' (L) optical surface (17), which is concave in the illustrated embodiment, has various radiuses of curvature. The reference numbers 17*a* and 17*b* identify the short and the long radius, respectively, of the optical surface (17). As described earlier, the lens (L) is held in a receptacle (not shown) while it is being shaped. Depending on the type of processing procedure being used, the receptacle can be rigidly mounted to the spindle of a processing machine, such as a lens polishing machine, or it can be mounted on gimbals on a center sleeve or an axially displaceable spindle, which generates the pressure required for the adjustment and processing procedures.

In the interest of simplicity, the figure only shows the elastic membrane (10) underneath the lens (L). In reality, of course, the elastic membrane (10) is attached to the holder (20); together, these two components delimit the cavity (15) filled with the ductile material (16). As described earlier, the membrane's (10) processing segment (11) is connected to the membrane's fastening segment (13) through the bellows-type segment (12). As it is depicted in FIGS. 2A and 2D, the membrane (10) is not being subjected to any forces, i.e., it is force-neutral.

In addition, as discussed above, the tool described in this invention is, depending on the processing procedure being used, either mounted on gimbals on a center sleeve or an axially displaceable spindle, or it is rigidly mounted to the spindle of a processing machine, whereby the center sleeve or the processing machine contains the transformer mentioned earlier, which is used to generate the thermal energy needed to complete the shaping procedure.

In order to conform the shape of the tool's processing segment (11) to that of the optical surface (17) being processed, the two spindle axles (workpiece spindle and tool spindle) are first brought into alignment with one another through the use of purely translational movements. This condition is shown in FIGS. 2B and 2E. At this point, the ductile material (16) located in the cavity (15) is heated through the holder's (20) energy transfer segment (25) (see FIG. 1), by the transformer (not depicted), until it becomes soft. This results in the tool and the lens (L) being pressed together. As can be deduced from FIGS. 2B and 2E, this causes the section of the lens (L) with the short radius (17*a*) to press against the outer edge (11*a*) of the membrane's (10) processing segment (11) with a force $F_A$, while the section of the lens with the long radius (17*b*), displaced by 90°, presses against a middle area of the processing segment (11) with a force $F_B$. As a result, the applied forces $F_A$ and $F_B$ create the unique distribution of inner forces $I_A$ and $I_B$ in the ductile material (16), as shown in the Figures.

As shown in FIG. 2B, the force $F_A$ acts, via the outer edge (11*a*) of the membrane's (10) processing segment (11), on the membrane's bellows-type segment (12) in such a way, that the angle formed by the radially tapering segment (12*a*) and the radially widening segment (12*b*) becomes locally smaller. This causes the section of the bellows-type segment (12) in which segments 12*a* and 12*b* meet to move in a radial direction toward the tool's center axis. This creates the inner forces $I_A$, which act on the ductile mass (16) as a displacement force. The cavity (15) is contained by the membrane (10) on the outside, by the holder (20) on the bottom, and by the projection (21) in the center, so that the ductile material (16) can only be displaced upward in the direction of the membrane's (10) processing segment (11); this, in turn, raises the center of the processing segment (11) in the direction of the optical surface (17).

At the same time, as shown in FIG. 2E, the force $F_B$ acts, in a 90° rotated plane, on the center of the membrane's (10) processing segment (11), pushing it toward the projection (21) of the holder (20). This creates the inner forces $I_B$, which act on the ductile mass (16) as a displacement force. Because the cavity (15) is delimited at the bottom by the projection (21) of the holder (20), the ductile material (16) can only be displaced radially toward the outside. When this occurs, the ductile material (16) presses against that part of the membrane's (10) bellows-type segment (12) where its two segments (12*a* and 12*b*) come together. Because, on the one hand, the membrane's (10) fastening segment (13) is rigidly mounted through the tension ring (18) (FIG. 1) to the holder (20) and, on the other hand, the outer edge (11*a*) of the processing segment (11) cannot be significantly displaced radially toward the outside, the outer edge (11*a*) of the processing segment (11) is, consequently, raised in the direction of the optical surface (17).

The process described above continues until every point on the surface of the membrane's (10) processing segment (11) is in contact with the lens' (L) optical surface (17). At that point the processing segment (11) forms a complete negative impression of the lens (L). This condition is shown in FIGS. 2C and 2F.

Finally, when heat transfer to the ductile material (16) is discontinued, the ductile material (16) cools and congeals, which results in the tool having the same curvature as the lens (L), in the form of a negative impression. At this point, the tool can be used to begin precision processing of the optical surface (17).

Thus, the tool described in this invention can be shaped to conform to any lens curvature. The shaping procedure is identical in all instances, which means that in order to process a lens with a different curvature, the tool can be used to shape the lens in exactly the same manner as described above.

Based on the above description, it is apparent that the radially widening segment (12*b*), which adjoins the radially tapering segment (12*a*) of the bellows-type segment (12), has a significant influence on the ductile behavior of the membrane's (10) processing segment (11). This bellows-type design ensures that the processing segment (11) can be shaped all the way to its outer edge (11*a*), as the bellows-type segment (11) is not subject to tensile forces which, if this segment had been designed as a cylinder, would cause the outer edge of the processing segment to recede.

Incorporating the third, radially tapering, segment (12*c*) of the bellows-type segment (12) into the design ensures that the outer edge (11*a*) of the processing segment (11) can assume widely varying heights with respect to the axis formed by the tool and the holder (20). Because of this feature, the tool is also suitable for processing lenses with very strong curvatures.

Based on FIGS. 2*a* through 2F, it is also apparent that the membrane's (10) processing segment (11) is smaller than the optical surface (17) being processed. This specification results from the fact that the tool's entire processing surface must be shaped, including the outer edges. However, the difference in size between the two surfaces is limited by the fact that the oscillation lift present during processing must compensate for that difference, so that the entire surface of the lens can be processed.

Finally, it should be noted that, in principle, the tool can also be shaped to conform to optical surfaces without incorporating the projection (21), as the inner forces (I) acting on the ductile material (16) in the direction of the tool's center axis can also be supported by the ductile material (16) itself.

Figure 3:
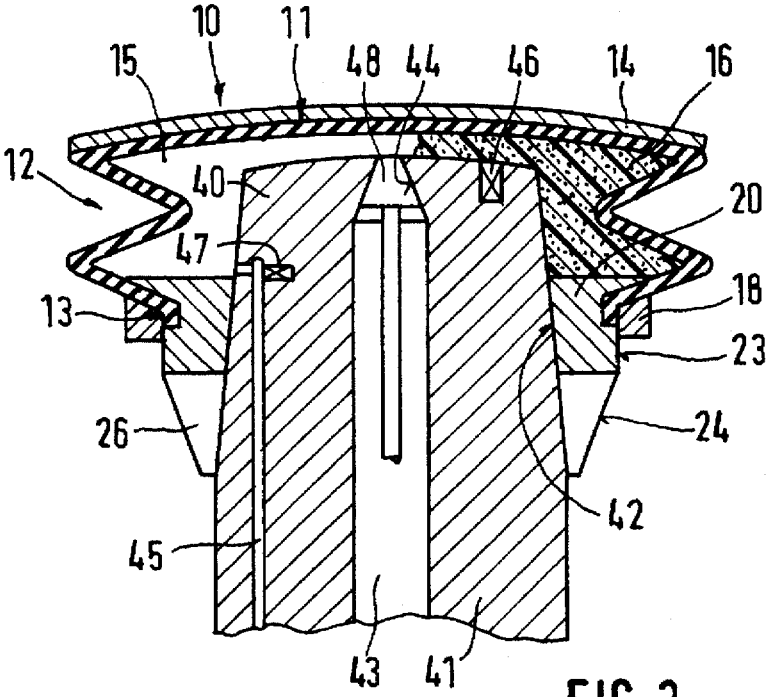
FIG. 3 is a sectional view of a second embodiment of the tool based on the invention.

FIG. 3 depicts a second embodiment of the invention. As the components corresponding to those shown in the first embodiment (FIG. 1) are labeled with the same reference numbers, they do not require any detailed explanation in the following text.

The main difference between the first two embodiments is that the holder (20) is designed differently in the second embodiment. In contrast to the first embodiment, the holder (20) in the second embodiment does not incorporate the projection described earlier as a single unit. Instead, the projection (40) is part of a center sleeve (41) that belongs to the transformer (not depicted here). The center sleeve (41) has a conical fastening segment (42), which projects into the projection (40), connecting it to a corresponding opening in the holder (20). In contrast to the first embodiment, the tip of the projection (40) is an arched surface (as opposed to being flat) to reduce the volume in the cavity (15).

An inflow channel (43) for the ductile material (16) runs through the center of the center sleeve (41). This inflow channel (43) opens into a nozzle (44) located at the tip of the center sleeve (41). A suitable check valve (48), which is used to close the nozzle, is built into the inflow channel (43). One or more ventilation channels (45) are built into the center sleeve (41). These ventilation channels (45) are located in proximity to the center sleeve's outer circumference and run parallel to the inflow channel (43). The ends of the ventilation channels (45) closest to the membrane continue in a radial direction toward the outer circumference of the projection (40), and are connected to the cavity (15) near the holder (20). The ventilation channels (45) are also equipped with suitable closure devices (not depicted). Finally, a pressure sensor is built into the arched surface of the projection (40), while the ventilation channels (45) have sensors (47) which detect the ductile material (16).

In this embodiment, the cavity (15) can be filled with a predetermined quantity of the ductile material (16), depending on the curvature of the lens being processed. In order to do this, the check valve (48) is opened and the heated ductile material (16) is pressed into the cavity (15). The air in the cavity (15) is displaced by the ductile material being introduced into the cavity (15), and is removed through the center sleeve (41), by means of the ventilation channels (45). As soon as the sensors (47) in the ventilation channels (45) detect escaping ductile material (16), i.e., when the air with which the cavity (15) was initially filled has been completely removed, the appropriate closure device seals off the ventilation channel in question (45). The pressure sensor (46) detects the pressure of the ductile material (16). The check valve (48) closes as soon as the pressure of the ductile material (16), as measured by the pressure sensor (46), is equal to an empirically determined pressure level required for the shaping procedure in question.

This embodiment makes it easier to monitor changes in the condition of the ductile material (16), thus ensuring a greater measure of control over the various steps of the shaping procedure.

As in the first embodiment the ductile material (16) in the cavity (15) of the tool shown in the second embodiment is heated and/or cooled by way of heat transfer through the projection (40) and/or the center sleeve (41). As the equipment used for heat generation is part of the transformer, it is not shown in FIG. 3.

Figure 4:
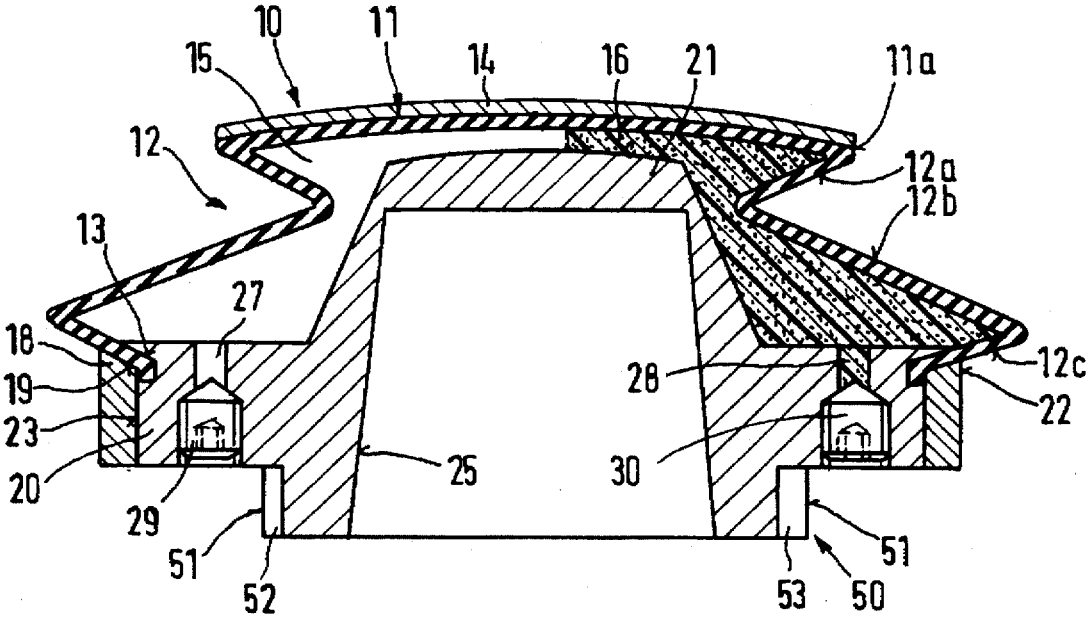
FIG. 4 is a sectional view of a third embodiment version of the tool based on the invention

FIG. 4 depicts a third embodiment of the tool described by this invention. Once again, the components corresponding to those shown in the first embodiment (FIG. 1) are labeled with the same reference numbers, so that the following text only covers attributes which differ from those of the earlier embodiments.

In the third embodiment, the radially tapering segments (12*a* and 12*c*) and the radially widening segment (12*b*) of the membrane's (10) bellows-type segment (12) have different diameters, which makes it possible to exert a considerable amount of influence on the ductile behavior of the membrane's (10) processing segment (11), as well as that of the outer edge (11*a*) of the processing segment (11). In this embodiment, the tension ring (18) used to attach the membrane (10) to the holder (20) completely covers the holder's (20) cylindrical outer surface (23).

In addition, the face of the projection (21) opposite the processing segment (11) of the membrane (10) is rounded and has a conical mantle surface. This makes it possible to reduce the volume of the ductile material (16) in the cavity (15), thus minimizing the amount of energy and time required to complete the shaping of the tool.

Finally, the third embodiment has a special socket (50), whose clamping surface (51) is rectangular in cross-section, when viewed in the direction of the tool's center axis. The clamping surface (51) has two v-shaped recesses (52, 53), which run parallel to the tool's center axis and are used to clamp the tool onto the tool spindle in interlocking fashion. As FIG. 4 clearly shows, the v-shaped recesses (52, 53) are embedded into the clamping surface (51) at varying depths, thus enabling recognition of the tool at 180°, which is necessary for processing optical surfaces that are not flip-symmetrical. This type of socket (50) is also known in the field as a "flat-back socket". In this particular case, the "flat-back socket" has been enhanced by an additional interlocking feature: the v-shaped recess (52).

The socket (50) depicted in FIG. 4 is particularly well-suited for processing procedures in which the tool guides the lens, as it allows for the application of strong tensile forces. The clamping itself is done through a clamping lever (not depicted), which exerts a force onto one side of the clamping surface, pressing the opposite side of the clamping surface (51) against a stop face (not depicted), which has a v-shaped projection. This projection grips into the clamping surface's (51) v-shaped recess (53), positioning the tool in relation to the processing machine or the transformer. This arrangement reliably prevents lateral slippage of the tool.

Figure 5:
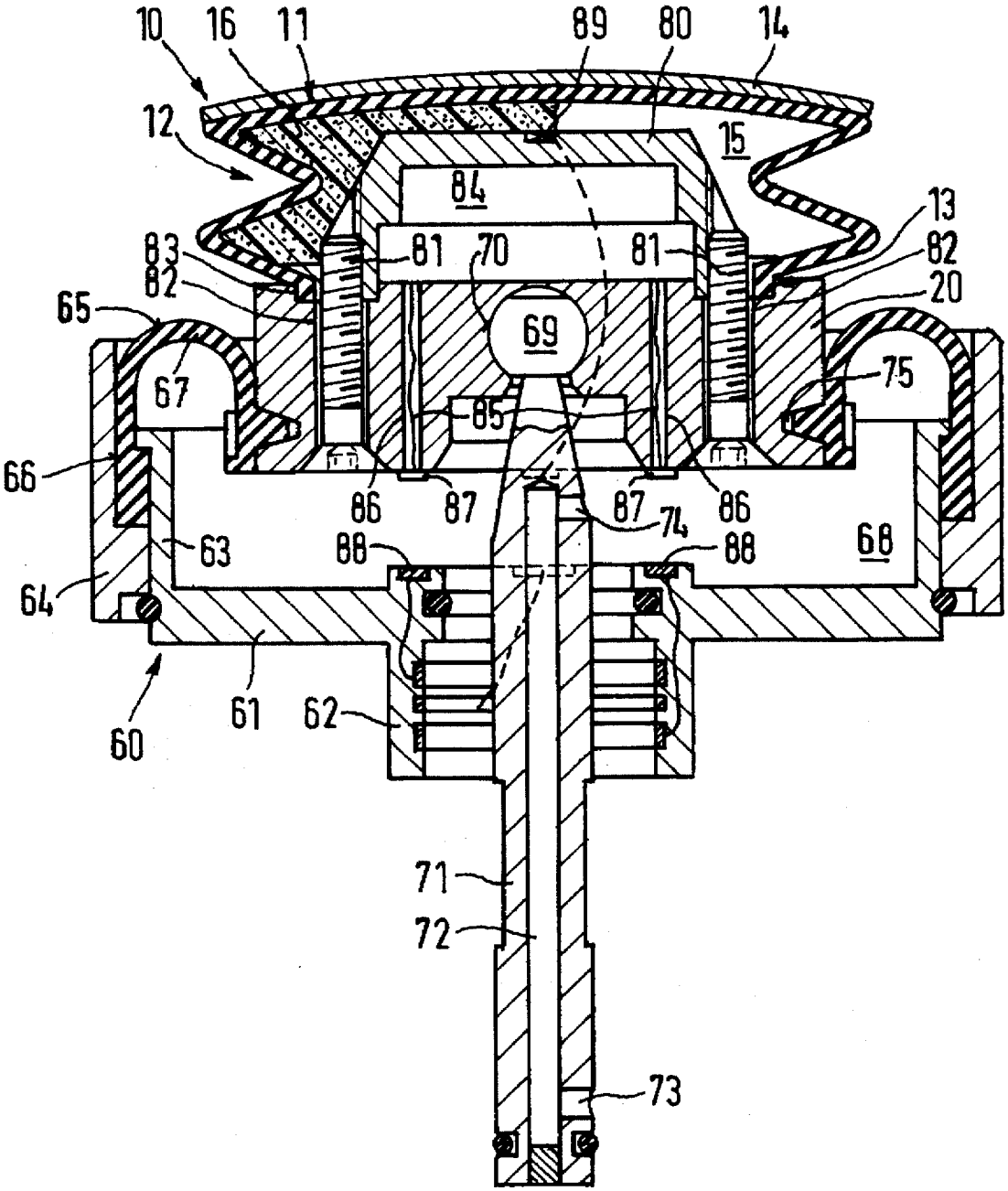
FIG. 5 is a sectional view of a fourth embodiment version of the tool based on the invention, which is attached to a guiding device based on the applicant's patent DE 42 14 266 A1

FIG. 5 depicts a fourth embodiment of the tool described in this invention. This tool is attached to a rotationally symmetrical receptacle case (60) which, in ram, is attached to the center sleeve of a grinding or polishing machine (not depicted). This receptacle case (60) is part of a device designed to guide tools, as described under the applicant's patent DE 42 14 266 A1. For further information regarding the overall construction of this device, see the text of DE 42 14 266 A1.

Once again, the components of the fourth embodiment which correspond to those shown in previous embodiments are labeled with the same reference numbers, so that the following text only covers attributes which differ from those of the earlier embodiments. The receptacle case (60) incorporates a bell-shaped flange (61) with a concentrically hollow pinion (62). When installed, it is mounted—non-rotatable and axially non-displaceable—onto and appropriately secured to a lower end of the center sleeve (not depicted). The outside wall (65) of a roller hose (66) is tightly stretched between the flange's (61) outside wall (63) and an external ring (64) attached to the wall. The inner wall (67) of the roller hose (66) is tightly secured to the rigid holder (20) of the tool described in this invention; a v-shaped peripheral groove (75) is incorporated into the holder (20) for this purpose. The roller hose (66) is made of an elastomer material with built-in reinforcing material, which prevents the roller hose (66) from being stretched elastically, but does not prevent the roller hose (66) from bending. Without being stretched, the roller hose (66) can complete rolling movements, and is not flexible in its circumferential direction. As a result, the holder (20) cannot rotate in relation to the flange (61) during tool operation. The roller hose (66) seals off a joint chamber (68), which is delimited primarily by the flange (61) and the holder (20).

The joint chamber (68) contains a ball-and-socket joint, which consists of a spherical head (69) that engages a ball socket (70) located in the holder (20). The spherical head (69) is located at the free end of a guide pin (71). The guide pin (71) is fed through an axially displaceable guide bush, which is inserted into an axial bore hole which, in turn, passes through the length of the center sleeve (not depicted) of the grinding or polishing machine. The guide pin (71) contains a vertical bore hole (72), which is sealed at both ends. A lower horizontal bore hole (73) connects the vertical bore hole (72) to the center sleeve's axial bore hole, while an upper horizontal bore hole (74) connects it to the joint chamber (68), which forms a pressure chamber. The aforementioned bore holes connect the pressure chamber to a pressure cylinder and piston arrangement (not depicted), which moves the center sleeve in an axial direction. In this way, the pressure chamber can be subjected to the pressure generated by the pressure cylinder and piston arrangement.

Due to the fact that the roller hose (66) is inflexible in a circumferential direction, the receptacle case (60) and its ball-and-socket joint (69, 70) forms, together with the roller hose (66), a precise zero-backlash homokinetic coupling between the holder (20) and the flange (61). The roller hose (66), which is inflexible in a circumferential direction, does not obstruct the holder's (20) ability to tilt around the ball-and-socket joint (69, 70) and against the flange (61). As a result, the holder (20) can complete unrestricted tilting compensatory movements. In addition, the roller hose (66) hermetically seals the ball-and-socket joint (69, 70) against abrasive polishing and grinding agents.

With the help of the patented tool guiding device mentioned earlier, the center sleeve can be automatically advanced or adjusted in its operating position while, at the same time, the receptacle case continues to provide optimal compensatory effectiveness. Therefore, this device is particularly well-suited for generating and maintaining the levels of processing pressure between the tool and the lens needed for processing optical surfaces. For further information on how this device operates, see DE 42 14 266 A1.

One of the ways in which the tool described in this invention, which is attached to the tool socket of the tool guiding device (through the roller hose (66) and the holder's (20) v-shaped circumferential groove (75)), differs from the embodiments described earlier is that a flange (80) is attached to the face of the holder (20) that faces the membrane's (10) processing segment (11). This flange (80) projects into the cavity (15) in the same manner as the projections (21, 40) described in conjunction with the embodiments depicted in FIGS. 1, 3 and 4. A number of screws (81) (e.g., 6 screws) that are spaced around the circumference of the flange (80) connect the flange (80) to the holder (20). Ideally, two of the screws' (81) bore holes or screw taps (82) in the holder (20) will extend in an axial direction through the entire holder (20) and through the flange (80). These bore holes (82) are used to fill the cavity (15) with the ductile material (16), which is the same function that is performed by the channels (27, 28) depicted in FIG. 1.

The outer edge of the flange (80) includes a ring-shaped recess (83) which anchors the membrane's (10) fastening segment (13). This ring-shaped recess (83) is located in the face of the holder (20) that faces the membrane's (10) processing segment (11). This eliminates the need for a separate tension ring.

In addition, the flange (80) contains an arrangement (84) for heating or cooling the ductile material (16), such as a cascade of Peltier elements. Cables (85), which are fed through bore holes (86) located inside the holder (20), and which run in the axial direction of the tool, are used to deliver an external electrical charge to the Peltier elements. To this end, contacts (87), which are electrically connected to the Peltier elements (84) through the cable (85), are attached to the face of the holder (20) facing away from the membrane (20). During the shaping procedure, these contacts (87) can be coupled with another set of contacts (88), which are attached to the face of the receptacle case's (60) pinion (62), located on the side of the joint chamber (68), and which can be electrically connected to a power source (not depicted).

Finally, a sensor (89), built into the face of the holder (20) that faces the membrane's (10) processing segment (11), monitors changes in the condition of the ductile material (16). This sensor (89) is either permanently connected, in an appropriate manner, to the processing machine, or is connected to the processing machine through contacts (not depicted) which can be coupled during the shaping procedure (by the same method used to charge the Peltier elements). Depending on the ductile material (16) used, changes in its condition can be monitored in various ways. If the ductile material's (16) condition at certain temperatures is known, taking a temperature reading represents one monitoring option. Changes in the ductile material's (16) condition could also be monitored by taking a pressure reading when the membrane's (10) processing segment (11) hits the optical surface being processed; the resulting change in the condition of the ductile material (16) produces a change in the amount of pressure being applied to the flange (80) and the sensor (89).

The first step in the shaping procedure involves the center axes of the tool and the lens being brought into alignment by the processing machine. Then a vacuum is applied to the joint chamber (68) through the bore holes (72 through 74) in the guide pin (71), which causes the holder (20) to move, in opposition to the roller hose's (66) elastic force, toward the receptacle case's (60) pinion (62). This movement is limited by the pinion (62), which acts as a buffer. The contacts (87, 88) become connected to one another when the holder (20) hits the pinion (62), which causes an electrical current to flow from the power source (not depicted) into the cables (85) and the contacts (87, 88). As a result, the Peltier elements heat the ductile material (16) via the flange (80), and the ductile material (16) softens. The sensor (89) detects the change in the condition of the ductile material (16) and sends a signal to the processing machine. At this point, the shaping procedure can continue as described earlier in reference to FIGS. 2A through 2F.

As soon as the curvature of the membrane's (10) processing segment (11) has conformed to that of the optical surface being processed, the ductile material (16) is transformed from a soft to rigid state. This is achieved by changing the polarity of the power source, so that the Peltier elements have a cooling rather than a heating effect. As soon as the sensor (89) detects that the ductile material (16) has become rigid again, the processing machine separates the tool and the lens and the amount of pressure required for processing is applied to the joint chamber (68). This causes the holder (20) to move away from the pinion (62) and to assume its processing position in relation to the receptacle case (60) (see FIG. 5). At this point, processing of the optical surface can begin.

The above text described the heating or cooling of the ductile material (16) by electrical means. This can also be achieved with a fluid medium, such as hot or cold air, as well as tempered water or acetone, which can be supplied by the processing machine, via an appropriate connection, and fed into a chamber (not depicted) in the flange (80) through the bore holes (86); the drainage procedure occurs in the reverse sequence.

The version of the tool described in this invention depicted in FIG. 5 is particularly suitable for a processing procedure in which the lens guides the tool, as the lens does not have to be re-centered after it has been shaped, and can thus be processed immediately.

Figure 6:
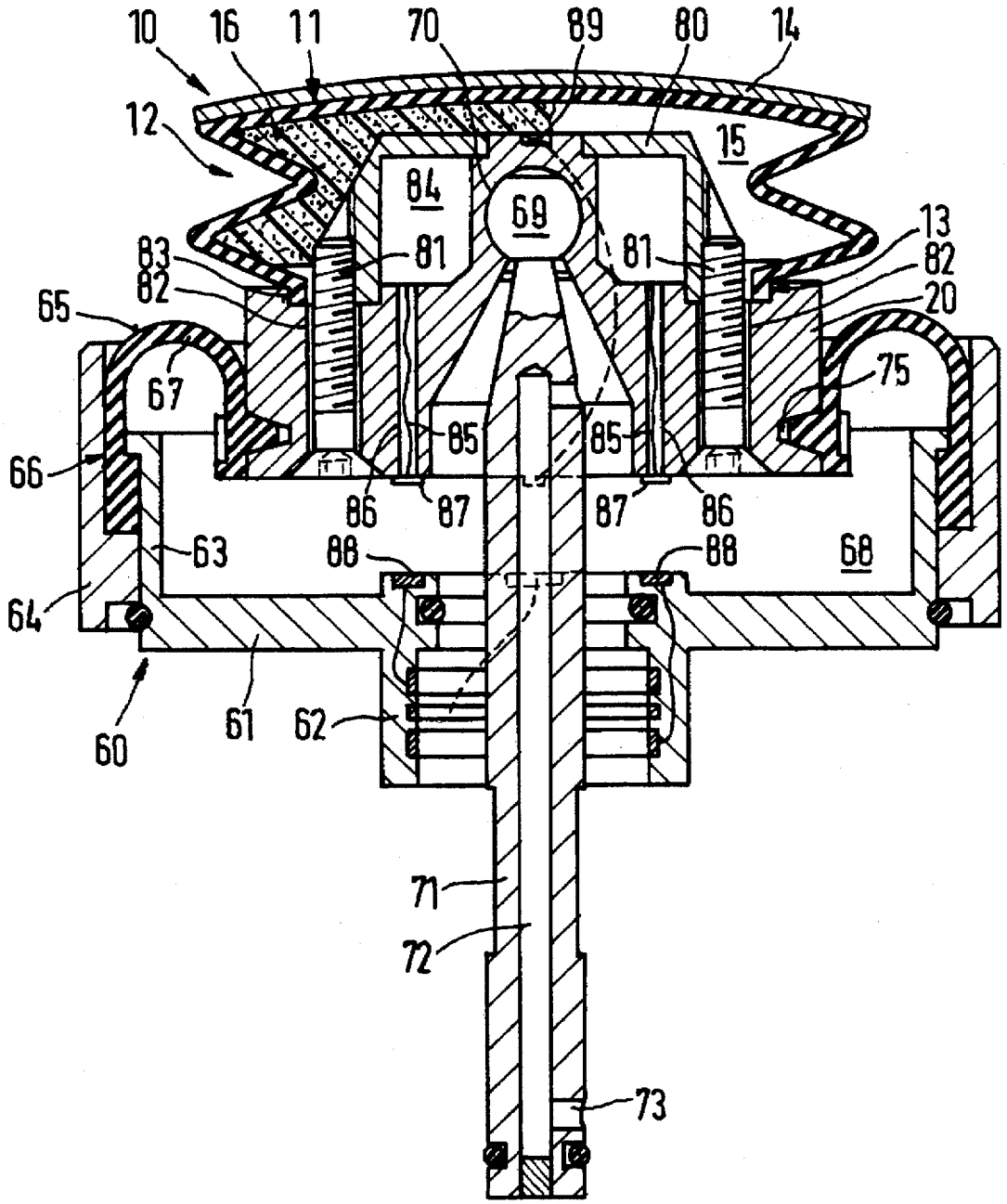
FIG. 6 is a sectional view of a fifth embodiment version of the tool based on the invention, which corresponds almost entirely to the fourth embodiment, with the exception of the inclusion of ring-shaped device designed to heat or cool the ductile material

FIG. 6 depicts a fifth embodiment of the tool described in this invention. The design of the fifth embodiment corresponds, for the most part, to that of the fourth embodiment described above. The only difference between the two embodiments is that the fifth embodiment uses a ring-shaped Peltier element (84) to heat or cool the ductile material (16). The advantage of this feature is that the swivel point of the ball-and-socket joint (consisting of a spherical head (69) and a ball socket (70))—and, therefore, the axial guide of the tilt-motion tool—can be located in close proximity to the membrane's (10) processing segment (11).

What is claimed is:

1. A tool for the precision processing of the optical surfaces of lenses, comprising:

a rigid holder;

an elastic membrane which includes a processing segment, a fastening segment which connects the membrane to the rigid holder, and a bellows-type segment which extends between the processing segment and the fastening segment;

the elastic membrane, together with the rigid holder defining a cavity;

the cavity being filled with a material which can be induced, in response to temperature changes, to form either a flexible or a rigid supporting layer for the membrane;

means for selectively heating and cooling the filling material to selectively transform the filling material between its flexible and rigid states; and whereby the membrane's outer profile can be shaped to conform to the shape of the optical surface of a lense to be processed by selectively transforming the filling material to its flexible state such that when the processing segment contacts the optical surface, the bellows-type segment applies forces (F) to the filling material, causing the filling material to press the processing segment against the optical surface, so that the tool retains its shape after the filling material becomes rigid.

2. A tool as recited in claim 1, wherein the processing segment has an outer edge, and the bellows-type segment further comprises a first segment which adjoins the outer edge of the processing segment and tapers conically toward the holder, and a second segment which adjoins the first segment, is connected to the fastening segment and widens conically toward the holder.

3. A tool as recited in claim 2, wherein the second segment of the bellows-type segment is connected to the fastening segment by means of a third segment which tapers conically toward the holder.

4. A tool as recited in claim 1, wherein the membrane consists of a synthetic material.

5. A tool as recited in claim 1, wherein the membrane consists of rubber.

6. A tool as recited in claim 1, wherein the filing material comprises a foamed material with memory capacity.

7. A tool as recited in claim 1, wherein the filing material comprises an alloy with a low melting point.

8. A tool as recited in claim 1, wherein the holder includes a projection that extends into the cavity.

9. A tool as recited in claim 1, wherein the holder includes a truncated recess embedded in the side of the holder which faces away from the membrane, the truncated recess acting as an energy transfer segment through which the filling material can be heated or cooled by an outside source.

10. A tool as recited in claim 9, wherein the heating/cooling means comprises at least one ring-shaped Peltier element.

11. A tool as recited in claim 1, wherein the holder includes at least one locking inflow channel for filling the cavity with the filling material and at least one locking outflow channel for removing air from the cavity during the filling process.

12. A tool for the precision processing of the optical surfaces of lenses, comprising:

a rigid holder;

an elastic membrane which includes a processing segment, a fastening segment which connects the membrane to the rigid holder, and a bellows-type segment which extends between the processing segment and the fastening segment;

the elastic membrane, together with the rigid holder defining a cavity;

the cavity being filled with a material which can be induced, in response to temperature changes, to form either a flexible or a rigid supporting layer for the membrane, wherein the filling material comprises a low melting point alloy which comprises a granulate of rigid material with a low specific gravity combined with a ductile material;

means for selectively heating and cooling the filling material to selectively transform the filling material between its flexible and rigid states; and whereby the membrane's outer profile can be shaped to conform to the shape of the optical surface of a tense to be processed by selectively transforming the filling material to its flexible state such that when the processing segment contacts the optical surface, the bellows-type segment applies forces (F) to the filling material, causing the filling material to press the processing segment against the optical surface, so that the tool retains its shape after the filling material becomes rigid.

13. A tool for the precision processing of the optical surfaces of lenses, comprising:

a rigid holder;

an elastic membrane which includes a processing segment, a fastening segment which connects the membrane to the rigid holder, and a bellows-type segment which extends between the processing segment and the fastening segment;

the elastic membrane, together with the rigid holder defining a cavity;

the cavity being filled with a material which can be induced, in response to temperature changes, to form either a flexible or a rigid supporting layer for the membrane;

means for selectively heating and cooling the filling material to selectively transform the filling material between its flexible and rigid states, wherein the holder includes a flange which projects into the cavity and which supports the means for heating and cooling the filling material: and whereby the membrane's outer profile can be shaped to conform to the shape of the optical surface of a lense to be processed by selectively transforming the filling material to its flexible state such that when the processing segment contacts the optical surface, the bellows-type segment applies forces (F) to the filling material, causing the filling material to press the processing segment against the optical surface, so that the tool retains its shape after the filling material becomes rigid.

14. A tool for the precision processing of the optical surfaces of lenses, comprising:

a rigid holder;

an elastic membrane which includes a processing segment, a fastening segment which connects the membrane to the rigid holder, and a bellows-type segment which extends between the processing segment and the fastening segment;

the elastic membrane, together with the rigid holder defining a cavity;

the cavity being filled with a material which can be induced, in response to temperature changes, to form either a flexible or a rigid supporting layer for the membrane;

means for selectively heating and cooling the filling material to selectively transform the filling material between its flexible and rigid states;

a sensor positioned inside the cavity for detecting a preselected condition of the filling material and responsively producing an output signal; and whereby the membrane's outer profile can be shaped to conform to the shape of the optical surface of a lense to be processed by selectively transforming the filling material to its flexible state such that when the processing segment contacts the optical surface, the bellows-type segment applies forces (F) to the filling material, causing the filling material to press the processing segment against the optical surface, so that the tool retains its shape after the filling material becomes rigid.

15. A tool as recited in claim 14, wherein the sensor monitors the temperature of the filling material.

16. A tool as recited in claim 14, wherein the sensor monitors the pressure of the filling material.

17. A tool as recited in claim 14, wherein the sensor is positioned in the cavity to face the membrane's processing segment.

* * * * *